US006808406B2

(12) United States Patent
Lee

(10) Patent No.: US 6,808,406 B2
(45) Date of Patent: Oct. 26, 2004

(54) EXPANSION MODULE AND PERSONAL DIGITAL ASSISTANT EQUIPPED THEREWITH

(75) Inventor: Huang-Lin Lee, Taoyuan (TW)

(73) Assignee: Quanta Computer, Inc., Taoyuan (TW)

( * ) Notice: Subject to any disclaimer, the term of this patent is extended or adjusted under 35 U.S.C. 154(b) by 110 days.

(21) Appl. No.: 10/269,607

(22) Filed: Oct. 11, 2002

(65) Prior Publication Data

US 2003/0236034 A1 Dec. 25, 2003

(30) Foreign Application Priority Data

Jun. 21, 2002 (TW) ..... 91209369 U

(51) Int. Cl.[7] ..... H01R 13/62
(52) U.S. Cl. ..... 439/298; 439/374
(58) Field of Search ..... 320/113, 115; 439/297, 298, 372, 374

(56) References Cited

U.S. PATENT DOCUMENTS

| | | | | | |
|---|---|---|---|---|---|
| 3,952,239 | A | * | 4/1976 | Owings et al. | 320/113 |
| 4,083,620 | A | * | 4/1978 | Burgin | 439/298 |
| 6,146,210 | A | * | 11/2000 | Cha et al. | 439/680 |
| 6,428,341 | B2 | * | 8/2002 | Kinezuka et al. | 439/358 |
| 6,612,858 | B1 | * | 9/2003 | Stockhaus | 439/352 |
| 6,702,604 | B1 | * | 3/2004 | Moscovitch | 439/374 |

* cited by examiner

*Primary Examiner*—Khiem Nguyen
(74) *Attorney, Agent, or Firm*—Thomas, Kayden, Horstemeyer & Risley

(57) ABSTRACT

An expansion module and a personal digital assistant equipped therewith. The personal digital assistant comprises a base unit and an expansion module. The base unit defines a guide slot and a fixing hole. The expansion module, disposed on the base unit in a detachable manner, includes an engaging member located in the guide slot and a positioning assembly combined with the fixing hole.

15 Claims, 9 Drawing Sheets

EXPANSION MODULE AND PERSONAL DIGITAL ASSISTANT EQUIPPED THEREWITH

BACKGROUND OF THE INVENTION

1. Field of the Invention

The invention relates to an expansion module and a personal digital assistant equipped therewith; in particular, a personal digital assistant, combined with an expansion module, with a pleasing appearance.

2. Description of the Related Art

The popularity and use of Personal Digital Assistants (PDAs) has increased in recent years. A PDA is a lightweight, compact productivity and communications tool that can typically be held in one hand, leaving the other hand free to input data with a pen type stylus or a reduced size keyboard. A PDA provides computing and information storage and retrieval capabilities for personal or business use. Typical uses include schedule and address book storage and retrieval, as well as note-taking functions. In addition, many PDAs are capable of running a variety of application software packages (e.g., calculators, text and/or image editors, etc.).

As shown in FIG. 1*a* and FIG. 1*b* respectively, PDAs can be divided into two groups, All-In-One PDA 10, and expandable PDA 20.

The advantage of the PDA 10 is that its volume can be miniaturized to a particular specification. However, since the specification of the PDA is pre-determined, its function can only be expanded via a built-in CF (compact flash) slot or SD (secure digital) slot 11. By inserting a CF card or a SD card into the CF slot or the SD slot 11, the function of the PDA 10 can be expanded. As a result, the PDA 10 can add only one function via the CF slot or the SD slot 11, and its expandability is limited.

The advantage of the PDA 20 is that its expandability is better than that of the PDA 10. The PDA 20 can expand its function via a cover pack 22. When the PDA 20 is combined with different cover packs 22, its expanded function is also different. However, when the cover pack 22 is combined with the PDA 20, it surrounds a body 21 of the PDA 20. Thus, the whole volume of the PDA 20 becomes too large, affecting portability.

SUMMARY OF THE INVENTION

In order to address the disadvantages of the aforementioned personal digital assistant, the invention provides a personal digital assistant combined with an expansion module, with a pleasing appearance.

Accordingly, the invention provides an expansion module and a personal digital assistant equipped therewith. The base unit includes a guide slot and a fixing hole. The expansion module, disposed on the base unit in a detachable manner, includes an engaging member located in the guide slot and a positioning assembly combined with the hole. The expansion module preferably covers the base unit as a cover pack for the base unit.

In a preferred embodiment, the base unit includes a first connector, and the expansion module includes a second connector connected to the first connector so as to transmit signals between the base unit and the expansion module.

Furthermore, the second connector is a golden finger.

In another preferred embodiment, the expansion module includes a first surface facing the base unit and a second surface opposite the first surface, and the positioning assembly comprises a swaying member. The swaying member, disposed in the expansion module in a swayable manner, includes a first end and a second end. The first end protrudes from the first surface to be inserted into the hole to fix the expansion module on the base unit, and the second end protrudes from the second surface.

Furthermore, the positioning assembly further comprises an elastic member. The elastic member is disposed in the expansion module in a manner such that the elastic member abuts the swaying member to restrain the swaying member within a predetermined range.

It is understood that the elastic member may be a spring.

In another preferred embodiment, the engaging member is a hook.

In another preferred embodiment, the guide slot and the hole are formed on a surface, facing the expansion module, of the base unit.

The invention also provides an expansion module. The expansion module is used for a personal digital assistant defining a guide slot and a hole, and comprises a body, an engaging member, and a positioning assembly. The body is disposed on the personal digital assistant in a detachable manner. The engaging member is disposed on the body and located in the guide slot. The positioning assembly is disposed in the body in a swayable manner to combine with the hole.

BRIEF DESCRIPTION OF THE DRAWINGS

The invention is hereinafter described in detail with reference to the accompanying drawings in which.

DETAILED DESCRIPTION OF THE INVENTION

Figure 1A:
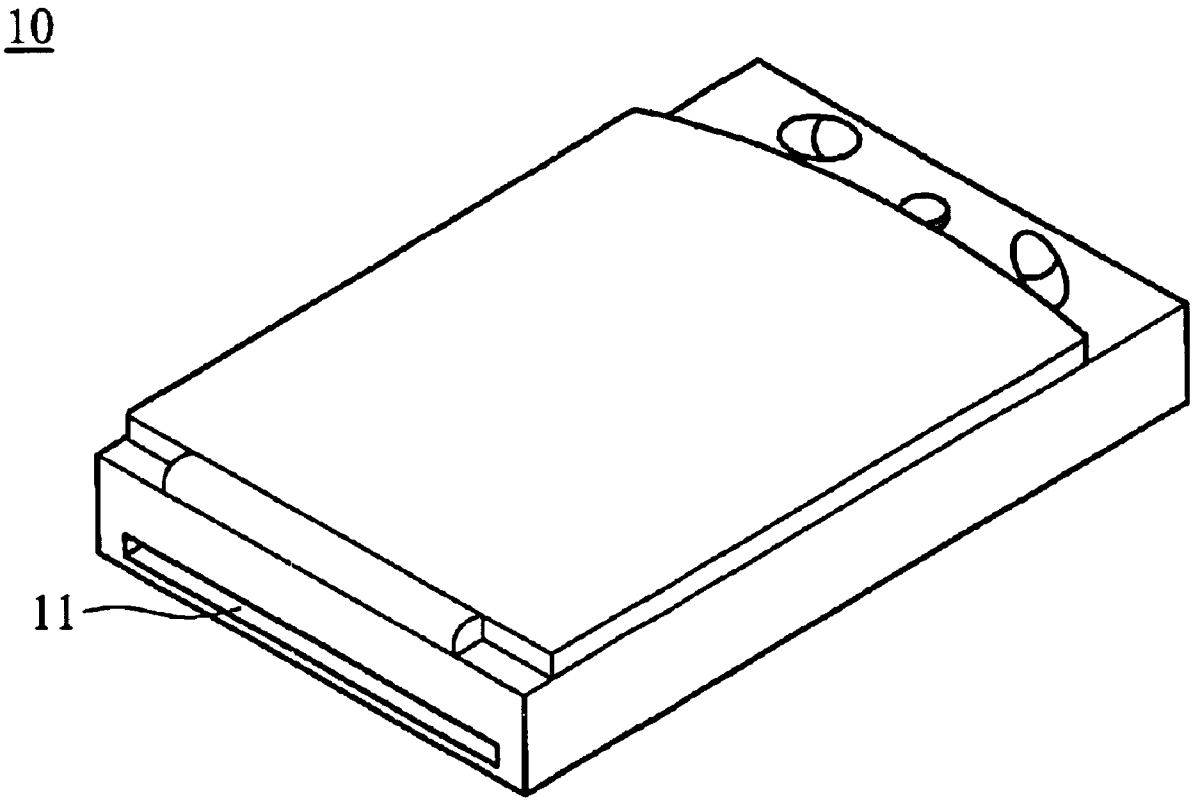
FIG. 1a (PRIOR ART)
FIG. 1*a* is a schematic view of a conventional all-in-one PDA.
Figure 1B:
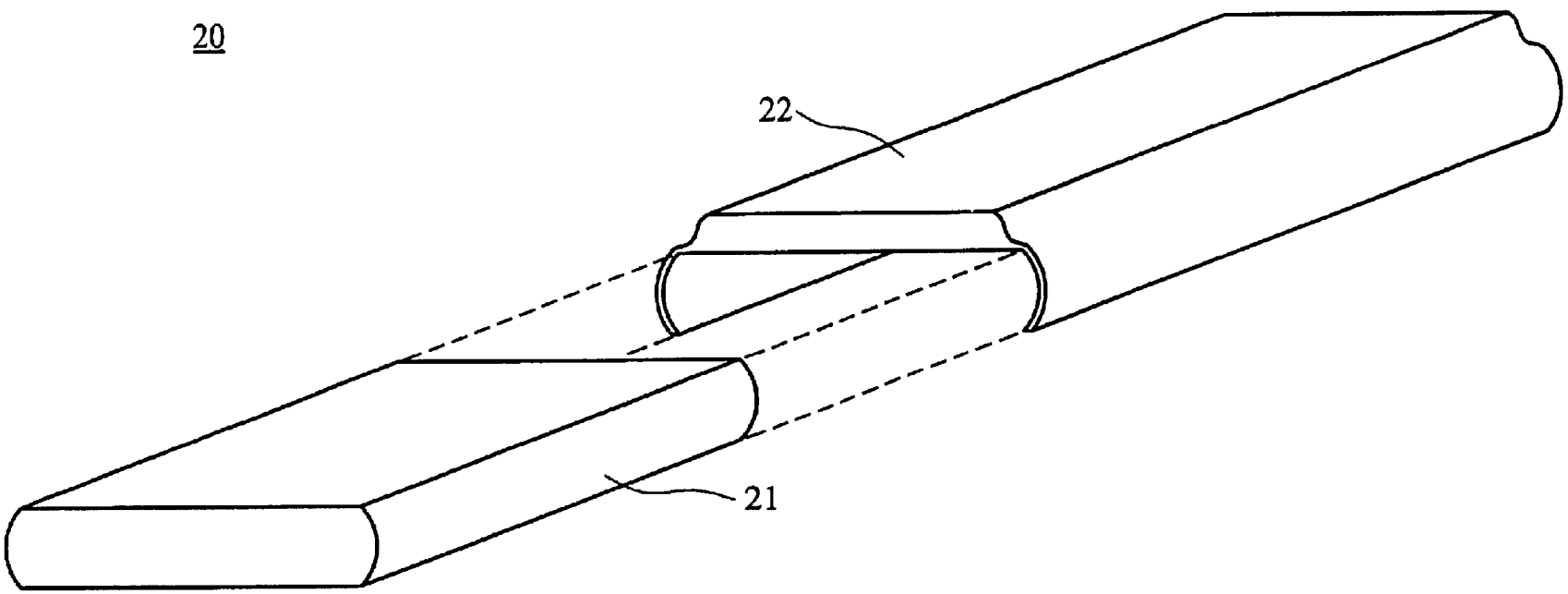
FIG. 1b (PRIOR ART)
FIG. 1*b* is a schematic view of a conventional expandable PDA.
Figure 2A:
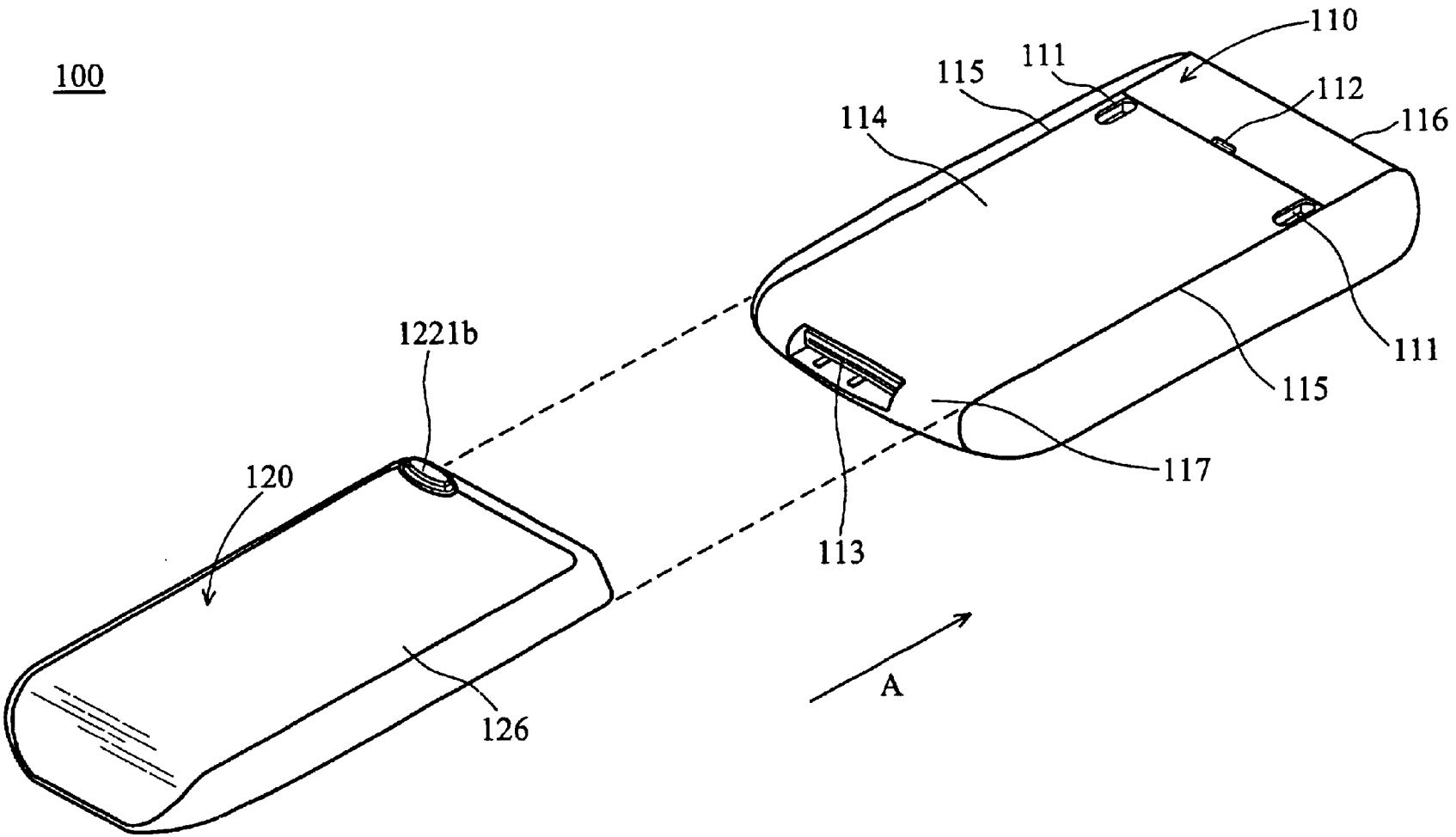
FIG. 2*a* is an exploded view of the PDA as disclosed in the invention.
Figure 2B:
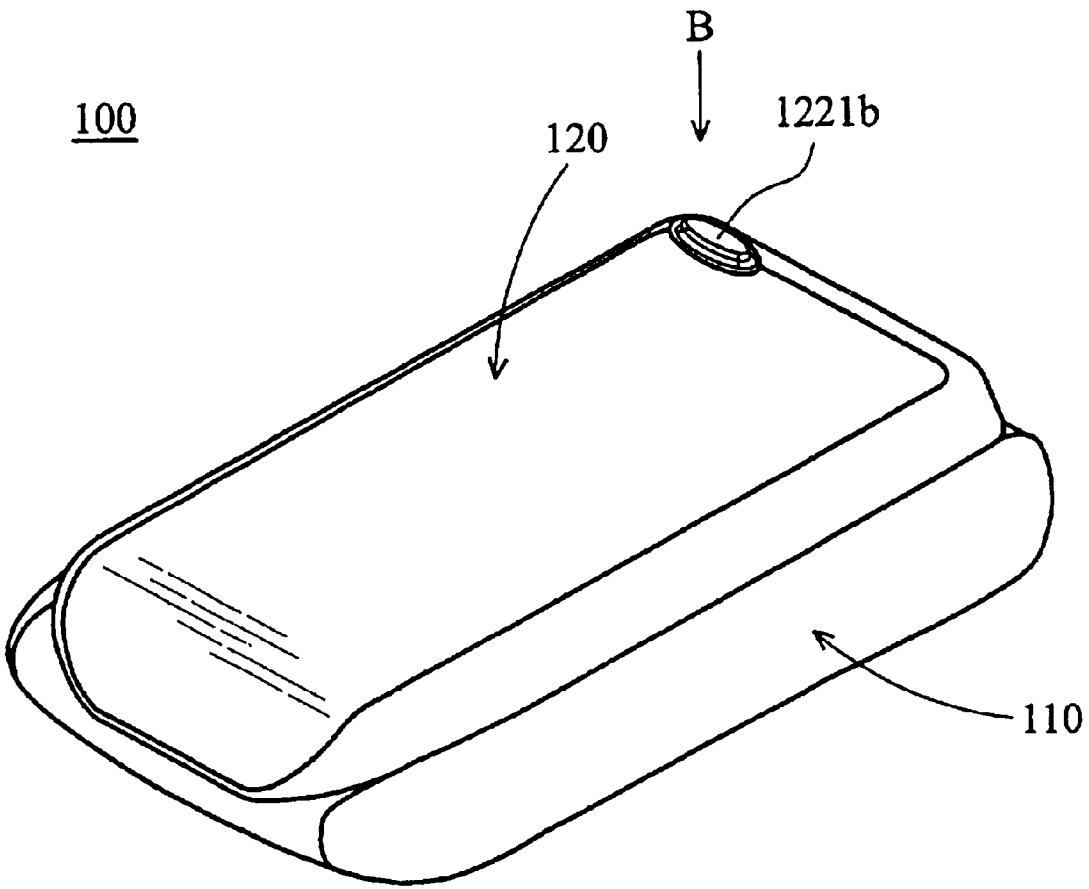
FIG. 2*b* is a perspective view of the assembled PDA in FIG. 2*a;*

Referring to FIG. 2*a* and FIG. 2*b*, a personal digital assistant 100 as disclosed in the invention comprises a base unit 110 and an expansion module 120. The expansion module 120 preferably covers the base unit 110 as a cover pack for the base unit 110. The base unit 110 is a body of the personal digital assistant 100, and includes basic functions of the personal digital assistant 100, such as CPU, memory, a liquid panel, a touch screen, a smart digital slot and others. Two guide slots 111 and a fixing hole 112 are formed on the base unit 110. The base unit 110 is also provided with a first connector 113. It is noted that the guide slots 111 and the fixing hole 112 are located on the same surface 114, facing the expansion module 120, of the base unit 110. Each of the guide slots 111 is substantially located near a side surface 115 of the base unit 110. The fixing hole 112 is substantially located near an end surface 116 and between the guide slots 111. The first connector 113 is located on another end surface 117 of the base unit 110.

Figure 3:
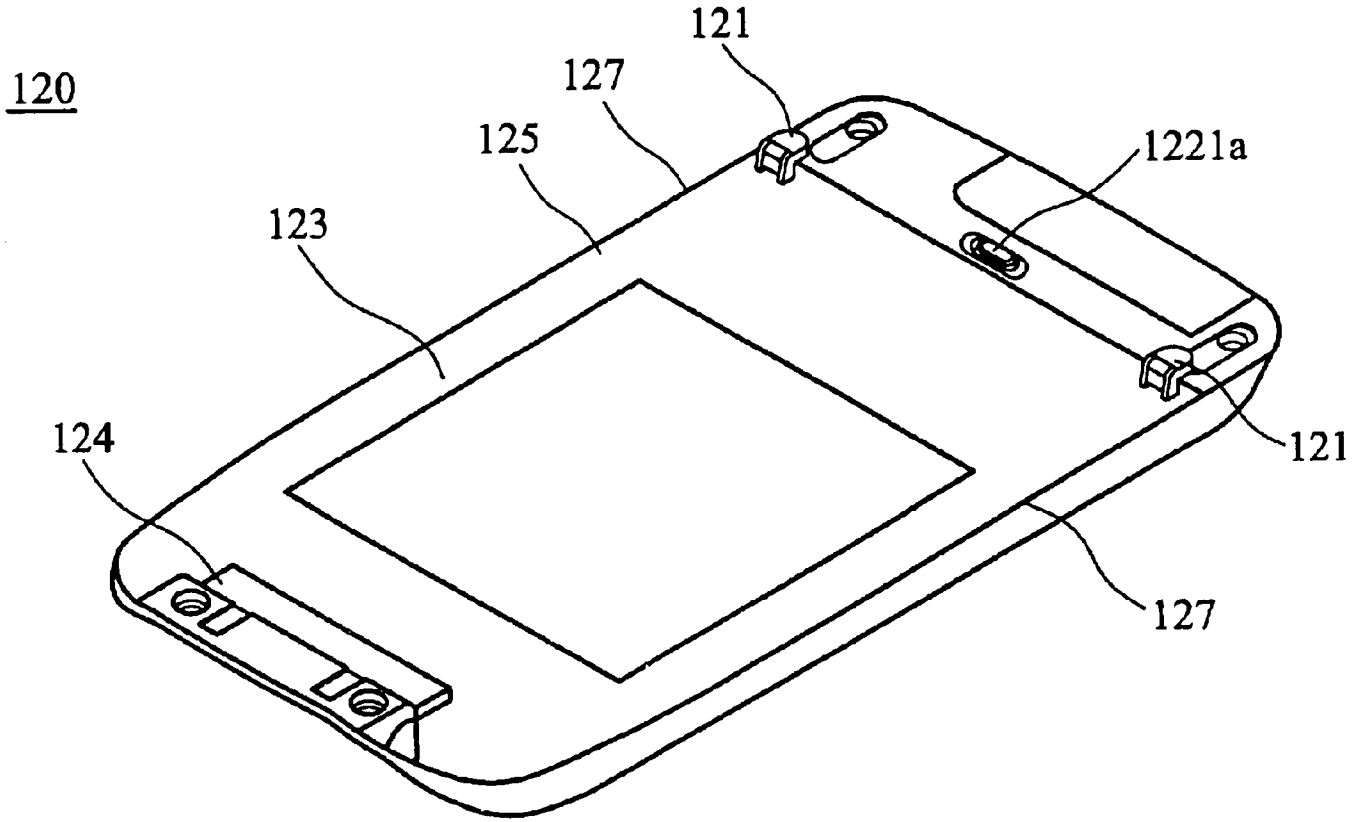
FIG. 3 is a perspective view of an expansion module as disclosed in the invention.

The expansion module 120 includes expanded functions required by the personal digital assistant 100, and is disposed on the base unit 110 in a detachable manner. FIG. 3 is a bottom perspective view of the expansion module 120. The expansion module 120 includes a body 123, two engaging members 121, a positioning assembly 122, and a second connector 124. In addition, referring to FIG. 2*a* and FIG. 3, the expansion module 120 includes a first surface 125 facing the base unit 110 and a second surface 126 opposite the first surface 125.

The body 123 is used as a basic structure of the expansion module 120. The engaging members 121 are disposed on the first surface 125 of the expansion module 120, and are substantially located near side surfaces 127 of the body 123 to correspond to the guide slots 111 of the base unit 110. When the expansion module 120 is disposed on the base unit 110, the engaging members 121 are located in the guide slots 111.

Furthermore, each of the engaging members 121 may be a hook as shown in FIG. 3.

Figure 4A:
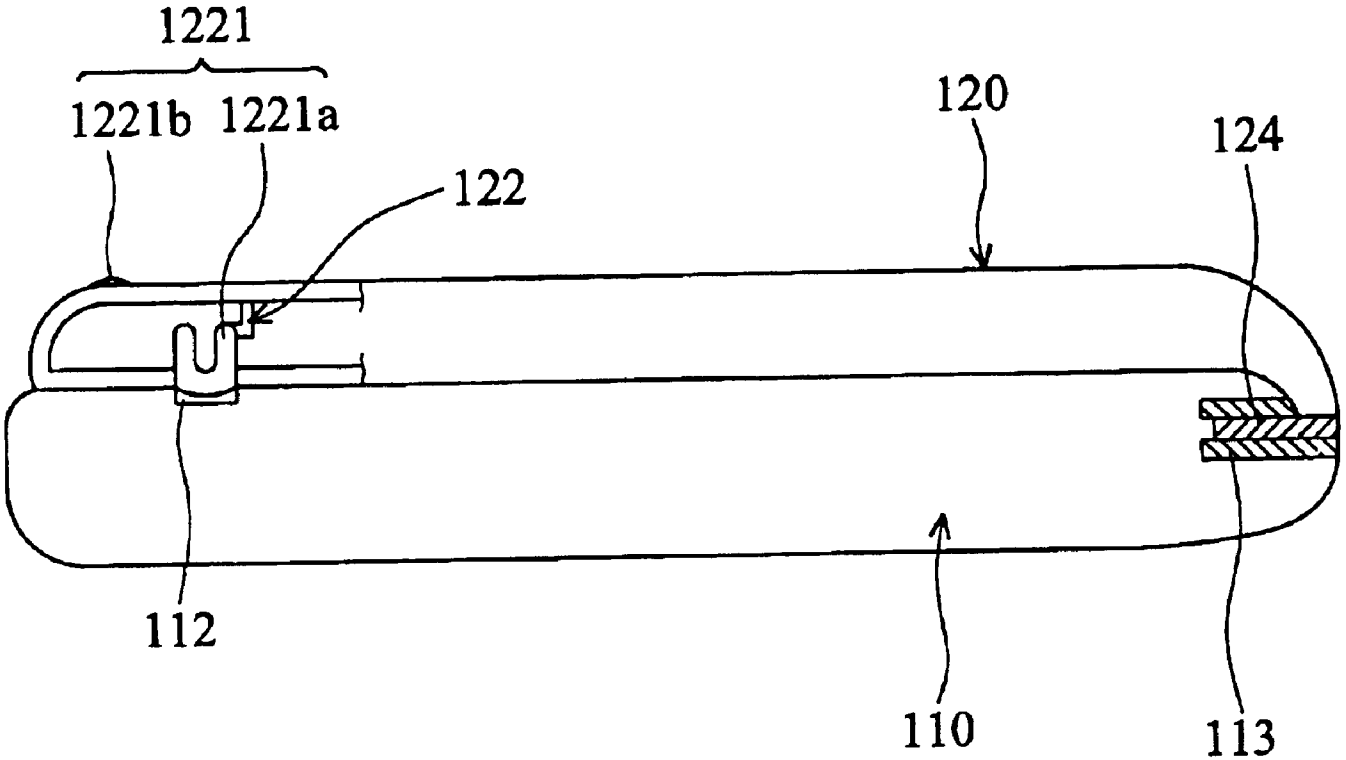
FIG. 4*a* is a cross section of the PDA in FIG. 2*b;*

Referring to FIG. 4*a*, the positioning assembly 122 is disposed in the body 123 of the expansion module 120, and includes a swaying member 1221. The swaying member 1221 is of elastic material so as to be disposed in the body 123 of the expansion module 120 in a swayable manner. The swaying member 1221 includes a first end 1221*a* and a second end 1221*b*. Referring to FIG. 3*a*, the first end 1221*a* protrudes from the first surface 125 to correspond to the fixing hole 112 of the base unit 110. Thus, when the expansion module 120 is disposed on the base unit 110, the first end 1221*a* is inserted into the fixing hole 112 so as to fix the expansion module 120 on the base unit 110. Referring to FIG. 2*a*, the second end 1221*a* protrudes from the second surface 126 so as to be used as a button. Thus, after the second end 1221*b* is pressed down along a direction B in FIG. 2*b*, the first end 1221 is disengaged from the fixing hole 112 to disassemble the expansion module 120 from the base unit 110.

Referring to FIG. 2*a* and FIG. 3, the second connector 124 is located near an end surface of the expansion module 120, and corresponds to the first connector 113 of the base unit 110. Thus, when the expansion module 120 is disposed on the base unit 110, the second connector 124 is connected with the first connector 113 so as to transmit signals between the base unit 110 and the expansion module 120. Furthermore, the second connector 124 may be a golden finger.

The structure of the personal digital assistant 100 is described as above, and the assembly/disassembly between the base unit 110 and the expansion module 120 is described as follows.

Figure 4B:
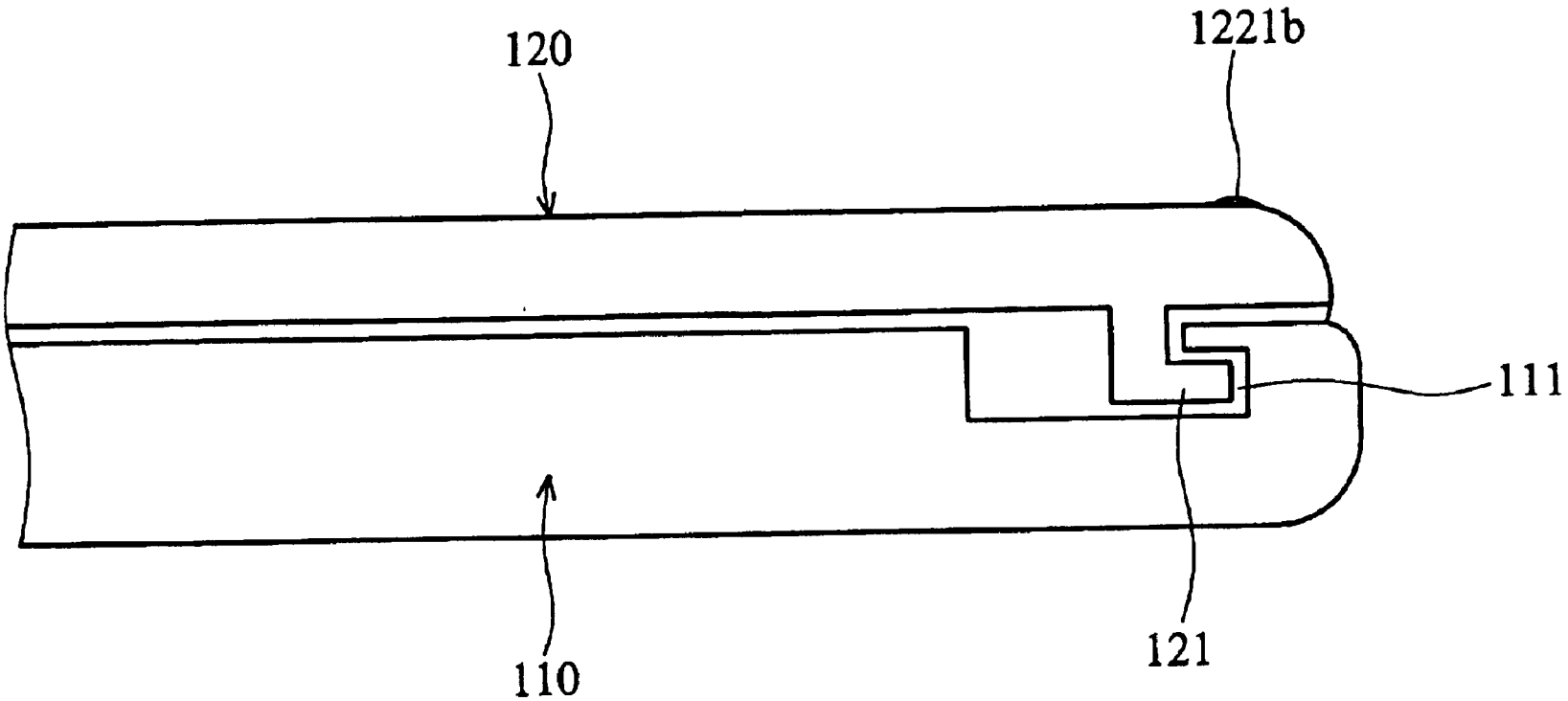
FIG. 4*b* is another cross section of the partial PDA in FIG. 2*b;*

As shown in FIG. 2*a*, the expansion module 120 is assembled on the base unit 110 along a direction A in FIG. 2*a*. Then, as shown in FIG. 4*b*, by inserting the engaging members 121 of the expansion module 120 into the guide slots 111 of the base unit 110, the expansion module 120 is positioned and attached on the base unit 110. Also, as shown in FIG. 4*a*, by inserting the first end 1221*a* of the swaying member 1221 into the fixing hole 112 of the base unit 110, the expansion module 120 is locked on the base unit 110. At the same time, as shown in FIG. 4*a*, the second connector 124 is also connected with the first connector 113 so that the expansion module 120 is combined with the base unit 110 more firmly.

In contrast, to disassemble the expansion module 120 from the base unit 110, the second end 1221*b* of the swaying member 1221 of the positioning assembly 122 is pressed down along a direction B in FIG. 2*b* so that the first end 1221*a* is disengaged from the fixing hole 112 of the base unit 110 to complete disassembly.

Figure 5A:
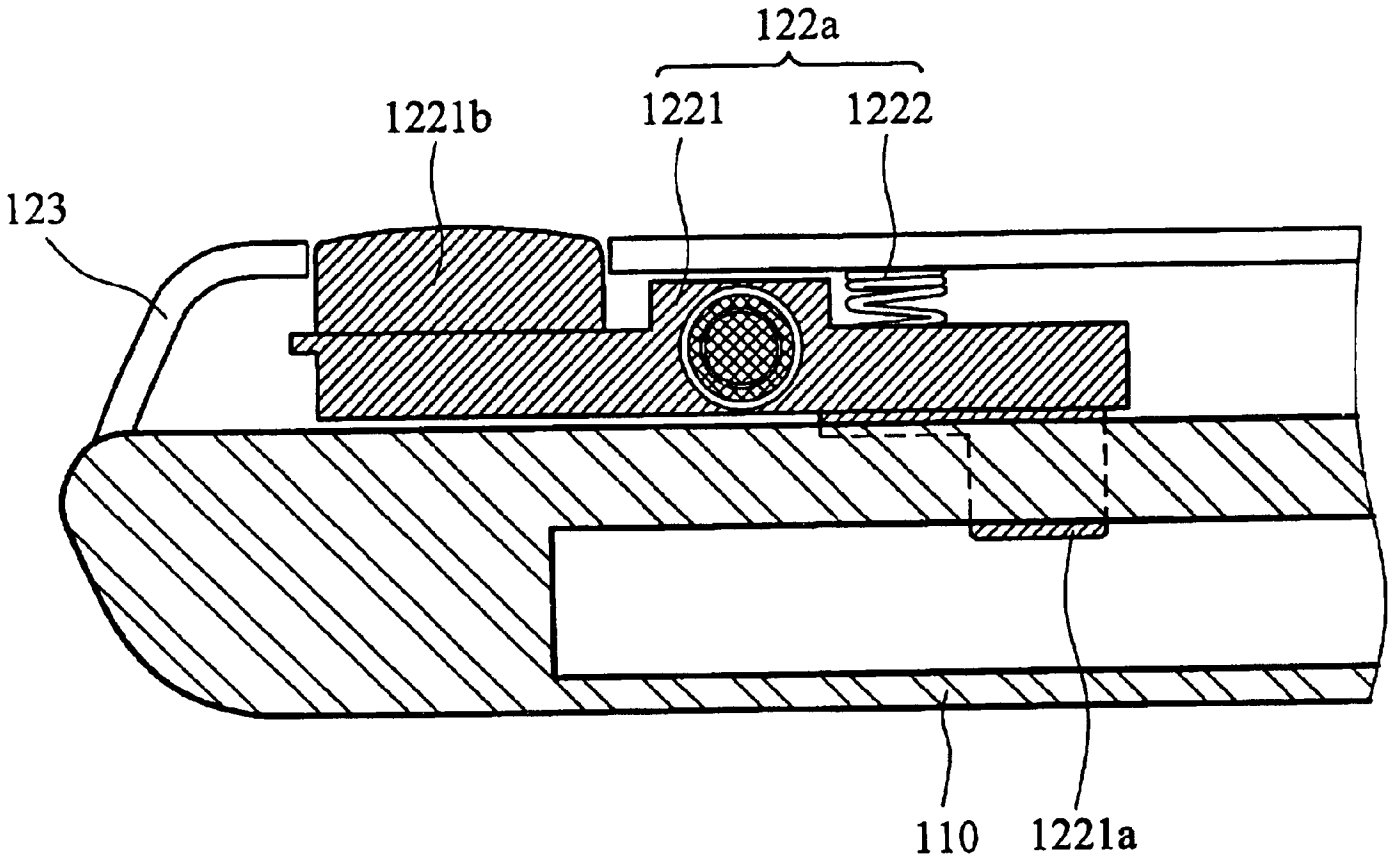
FIG. 5*a* is a schematic view of a variant embodiment of a positioning assembly in FIG. 4*a; and*
Figure 5B:
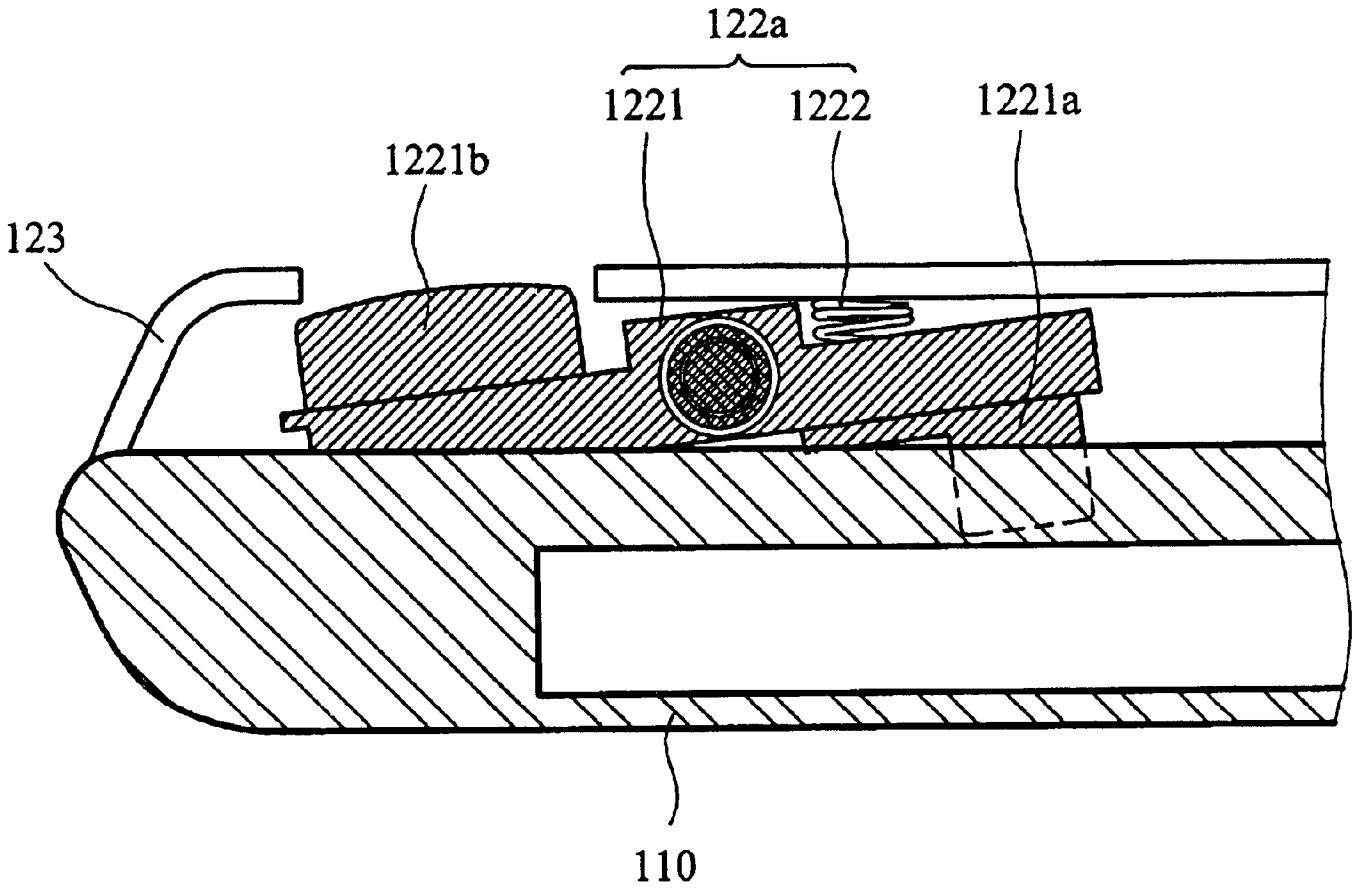
FIG. 5*b* is another schematic view of the positioning assembly in FIG. 5*a*, wherein an elastic member is depressed.

In addition, FIG. 5*a* and FIG. 5*b* show a variant embodiment of a positioning assembly. The positioning assembly 122*a* comprises the swaying member 1221 and an elastic member 1222. The elastic member 1222 is disposed in body 123 of the expansion module 120 in a manner such that the elastic member 1222 abuts the swaying member 1221. Thus, the elastic member 1222 provides recovery force to the swaying member 1221, and restrains the swaying member 1221 within a predetermined range. Furthermore, it is understood that the elastic member 1222 may be a spring as shown in FIG. 5*a*.

It is noted that in FIG. 4*a*, FIG. 4*b*, FIG. 5*a* and FIG. 5*b*, some components inside the base unit 110 and the expansion module 120 are removed to simplify description.

In sum, after the base unit 110 and the expansion module 120 are combined together, the appearance of the whole personal digital assistant 100 is neater and more appealing.

While the invention has been particularly shown and described with reference to a preferred embodiment, it will be readily appreciated by those of ordinary skill in the art that various changes and modifications may be made without departing from the spirit and scope of the invention. It is intended that the claims be interpreted to cover the disclosed embodiment, those alternatives which have been discussed above, and all equivalents thereto.

What is claimed is:

1. A personal digital assistant comprising:

a base unit with a guide slot and a fixing part; and an expansion module, disposed on the base unit in a detachable manner, including an engaging member located in the guide slot and a positioning assembly combined with the fixing part.

2. The personal digital assistant as claimed in claim 1, wherein the base unit includes a first connector, and the expansion module includes a second connector connected to the first connector so as to transmit signals between the base unit and the expansion module.

3. The personal digital assistant as claimed in claim 2, wherein the second connector is a golden finger.

4. The personal digital assistant as claimed in claim 1, wherein the expansion module includes a first surface facing the base unit and a second surface opposite the first surface, and the positioning assembly comprises:

a swaying member, disposed in the expansion module in a swayable manner, including a first end and a second end, wherein the first end protrudes from the first surface into the fixing part to fix the expansion module on the base unit, and the second end protrudes from the second surface.

5. The personal digital assistant as claimed in claim 4, wherein the positioning assembly further comprises:

an elastic member disposed in the expansion module in a manner such that the elastic member abuts the swaying member to restrain the swaying member swinging within a predetermined range.

6. The personal digital assistant as claimed in claim 5, wherein the elastic member is a spring.

7. The personal digital assistant as claimed in claim 1, wherein the engaging member is a hook.

8. The personal digital assistant as claimed in claim 1, wherein the guide slot and the fixing part are located on a surface, facing the expansion module, of the base unit.

9. An expansion module for a personal digital assistant with a guide slot and a fixing part, the expansion module comprising:

a body disposed on the personal digital assistant in a detachable manner;

an engaging member disposed on the body and located in the guide slot; and a positioning assembly disposed in the body in a swayable manner to combine with the fixing part.

10. The expansion module as claimed in claim 9, wherein the body includes a connector connected to a connector of the personal digital assistant so as to transmit signals between the personal digital assistant and the expansion module.

11. The expansion module as claimed in claim 10, wherein the connector is a golden finger.

12. The expansion module as claimed in claim 9, wherein the body includes a first surface facing the personal digital assistant and a second surface opposite the first surface, and the positioning assembly comprises:

a swaying member, disposed in the body in a swayable manner, including a first end and a second end, wherein the first end protrudes from the first surface to be inserted into the fixing part to fix the expansion module on the personal digital assistant, and the second end protrudes from the second surface.

13. The expansion module as claimed in claim 12, wherein the positioning assembly further comprises:

an elastic member disposed in the body in a manner such that the elastic member abuts the swaying member to restrain the swaying member swinging within a predetermined range.

14. The expansion module as claimed in claim 13, wherein the elastic member is a spring.

15. The expansion module as claimed in claim 9, wherein the engaging member is a hook.

* * * * *